US009668563B2

(12) United States Patent
Shorland et al.

(10) Patent No.: US 9,668,563 B2
(45) Date of Patent: Jun. 6, 2017

(54) DEODORANT PRODUCT APPLICATION DEVICE

(71) Applicant: Elementz LLC, London (GB)

(72) Inventors: Simon Shorland, London (GB); Samantha Cunningham, London (GB); Ben Mazur, Bristol (GB); Osama James Al-Mukhtar, Bristol (GB)

(73) Assignee: ELEMENTZ LLC, London (GB)

( * ) Notice: Subject to any disclaimer, the term of this patent is extended or adjusted under 35 U.S.C. 154(b) by 103 days.

(21) Appl. No.: 14/693,961

(22) Filed: Apr. 23, 2015

(65) Prior Publication Data

US 2015/0305473 A1 Oct. 29, 2015

Related U.S. Application Data

(60) Provisional application No. 61/983,205, filed on Apr. 23, 2014.

(51) Int. Cl.

| | |
|---|---|
| ***B05C 17/01*** | (2006.01) |
| ***A45D 34/04*** | (2006.01) |
| ***A45D 40/04*** | (2006.01) |
| ***A45D 40/02*** | (2006.01) |
| ***B05C 9/14*** | (2006.01) |
| ***B05C 21/00*** | (2006.01) |
| ***A45D 40/26*** | (2006.01) |

(52) U.S. Cl.

CPC ..... *A45D 34/041* (2013.01); *A45D 34/04* (2013.01); *A45D 40/02* (2013.01); *A45D 40/04* (2013.01); *A45D 40/26* (2013.01); *B05C 9/14* (2013.01); *B05C 21/00* (2013.01); *A45D 2200/20* (2013.01)

(58) Field of Classification Search

CPC ..... A45D 40/02; A45D 40/04; A45D 34/04

See application file for complete search history.

(56) References Cited

U.S. PATENT DOCUMENTS

2008/0107475 A1 5/2008 Wojcik

FOREIGN PATENT DOCUMENTS

| | | | |
|---|---|---|---|
| DE | WO 9504486 A1 * | 2/1995 | ..... A45D 40/02 |
| EP | 2 090 370 | 8/2009 | |

OTHER PUBLICATIONS

International Search Report for PCT/GB2015/051203.
Written Opinion of the International Searching Authority for PCT/GB2015/051203.
Translation of Abstract and Claims from European Patent Office for EP 2090370.

* cited by examiner

*Primary Examiner* — Jennifer C Chiang
(74) *Attorney, Agent, or Firm* — Donald J. Ranft; Collen IP

(57) ABSTRACT

A device and method for drying a substance applied to a surface as it is being applied to the surface. The device is designed to apply a form of energy including air movement, heat, or light and can be designed to apply combinations of energy forms. The energy form is applied to the surface during or after the substance has been applied to the surface. A design for the shape of the enclosure and features included in the enclosure for the device are disclosed which enhances the drying efficiency.

23 Claims, 14 Drawing Sheets

DEODORANT PRODUCT APPLICATION DEVICE

CROSS-REFERENCE TO RELATED APPLICATIONS

The present application claims priority to U.S. Provisional Patent Application Ser. No. 61/983,205 filed Apr. 23, 2014 and entitled DEODORANT PRODUCT APPLICATION DEVICE.

BACKGROUND OF THE INVENTION

Antiperspirants and deodorants are common everyday consumables that have been sold for many years and come in several common forms of delivery including aerosol sprays sold in cans, liquids in rollerball, solid stick, and gel form. This is not an exhaustive list as other less popular forms exist.

Advancements which are beneficial to the consumer are largely focused on the chemical formula that is applied on to the skin. This is mostly focused on how effective these products are at stopping perspiration or masking it. There are various formulas available ranging from normal strength formula up to clinical grade formula all aimed at consumers with problem perspiration. The products are normally associated with claims of protecting against perspiration for a given period of time, usually 24 and 48 hours.

Other advancements are to the chemical formula are focused on eliminating/reducing the staining of clothes which is often associated with antiperspirants and less so deodorants. Antiperspirants contain an active ingredient that is used to block the sweat ducts and prevent perspiration. There are different types of active ingredient but most are Aluminum salt based like Aluminum Chloride.

The active ingredients combined with electrolytes in sweat are acidic and it's the acidic nature that stains clothing especially when further reaction with washing detergent takes place. Health concerns associated with ingesting aluminum salts and the potential effects have led to other chemical advancements for alternatives to aluminum.

The one feature that has been short of advancement is that of the chemical formula drying and bonding to the skin. This is somewhat difficult from a chemical perspective because the product is applied to a sensitive part of the body and solutions that would easily improve drying such as an alcohol based formula would cause other problems for the user like skin irritation. Improved drying time has been addressed by the delivery mechanism but this falls a long way short of solving the problem of lengthy drying times. Features of the 4 most common forms are as follows:

Aerosol—very common delivery method that is mainly used in Europe. Aerosol delivery has the benefit of delivering a very thin layer of product and is best associated with quick drying times. Consumers however have less control over the accuracy of delivery due to the nature of a fine mist and also it can be unpleasant when sprayed in confined spaces. Consumer complaints can be fears on inhaling the gas as well as important environmental concerns. Modern aerosols are CFC free but still use other propellants like Propone and Butane, which are classed as VOC's (volatile organic compounds). Different countries have various rules and treatments for these aerosol VOC's with some making it very difficult for manufacturers to offer this format.

Solid Stick—a method developed to address some concerns with drying times. The chemical formula comes in a solid format by the addition of waxes. Although this product when rubbed onto the skin may initially feel drier than a liquid, consumers are faced with other shortfalls. Immediate staining of clothes, especially dark garments is very common. The waxes that make the solid form can cause the formula to coagulate together and be difficult to remove even with soaps.

Gel form—A more recent development to improve other product shortfalls. Gels are typically clear so don't give immediate staining, although their active ingredient when combined with sweat will cause staining of clothes. A gel dries quicker than a liquid since it is already in a less liquid form. Despite this, the drying times can be high with 5-10 minutes not uncommon. Delivery mechanisms of gels are typically crude with a form of pressure (plunger) forcing the gel through holes onto an applicator.

Rollerball—This form is most associated with the liquid form of formula. The rollerball is good for keeping the formula airtight and to a degree allows for quite a controlled amount of delivery of formula. Liquid antiperspirant is often reviewed as the most effective. Whilst effectiveness is actually associated with the percentage of the active aluminum (or other) ingredient that makes up the formula because the delivery is a liquid (much like the gel forms) the consumer can perhaps apply this more carefully. Liquid antiperspirants and deodorants delivered in this method still have high drying times, where 5-10 minutes is not uncommon.

Packaging is an environmental concern for many consumers. As antiperspirants and deodorants are mostly disposable items with a high degree of plastics and metals (for aerosols) the safe disposal of these packages is an environmental concern. Manufacturers of antiperspirants and deodorants are trending towards solutions with less packaging.

SUMMARY

A device and method for shortening the drying time of a moist substance such as a liquid, cream, or gel is disclosed. The device may contain the substance to be applied along with the mechanism for shortening the drying time. Or the device can be designed to attach to an existing vessel containing the moist substance to be applied. In one embodiment the device combines a system to move air with an applicator for antiperspirant or deodorant. The device results in vastly improved drying time of the substance or formula on the skin. The device can be part mechanical and part electrically powered by means of a power supply, in this case a battery.

In one embodiment the device uses well-known principles of fluid dynamics to create an airflow that moves across the surface of the skin and reduces the drying time of liquids and gel forms of antiperspirant and deodorant. In order to achieve the right direction of airflow the device employs a coanda surface. A coanda surface is a surface close to the exit of the airflow, in this case the air outlet collar, where airflow demonstrates the coanda effect. The air essentially hugs the contours of the coanda surface as it moves across it.

Fluid dynamic principles are also used to improve the volume of air moved by the device utilizing a multiplier effect. This is achieved by way of the Venturi-Ejector principle. Airflow is deliberately manipulated to increase velocity and decrease pressure, which has the effect of drawing air from the space surrounding the device into the main enclosure/housing and entraining the air.

The device is intended to be highly portable and small. A design described in detail below is similar in size to many disposable antiperspirants/deodorant containers sold today and is only limited by parts currently available.

This device significantly reduces the drying time of the antiperspirants and deodorant. And when the device is combined with a proprietary formula it vastly improves the drying time of any typical gel or liquid antiperspirant or deodorant.

The device features exchangeable vessels of antiperspirant or deodorant formula that will be disposed of or recycled once the formula is exhausted. The vessels can also be designed to be refilled. This exchangeable or refillable feature will allow for less wasteful packaging but also empower consumer choice as to the scent and formula strength including chemical active ingredient versus more natural formula. There is less packaging used because the mechanism for delivery of the formula is a permanent feature of the invention and not disposed of as with current antiperspirants and deodorants.

Other embodiments include: drawing the air away from the surface on which the substance is applied; drawing air away and simultaneously move air across the surface; drawing air from the sides of the device with air movement/delivery mechanism and air outlet on the bottom of the device; using a light source to quicken the drying time of the substance; and using a heat source to quicken the drying time of the substance.

PART NUMBERS FOR FIGS. 1-6

Figure 1:
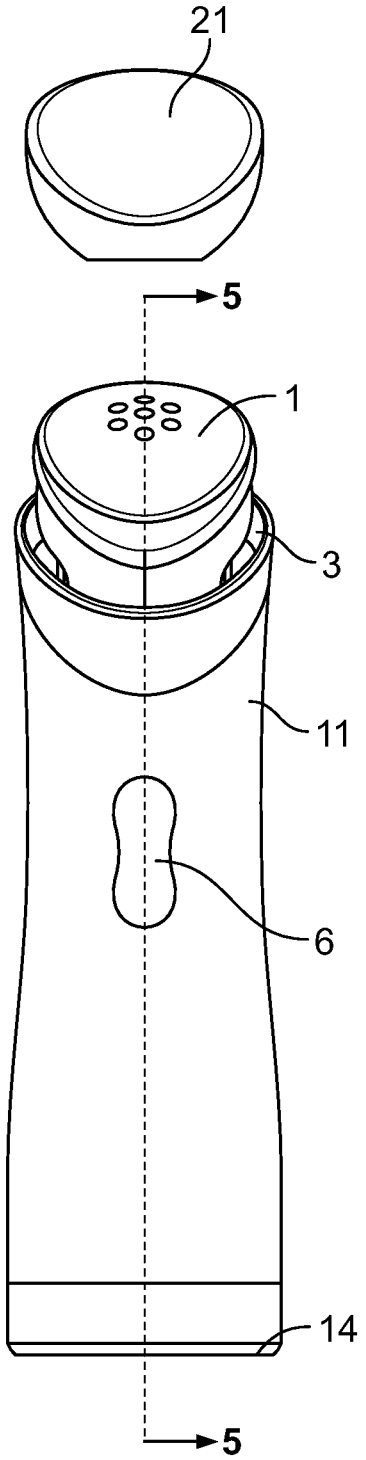
FIG. 1—Front view of the one embodiment showing applicator head 1, air outlet collar 3, power/control button(s) 6, enclosure 11, air intake 14 and applicator head lid/cover 21
Figure 2:
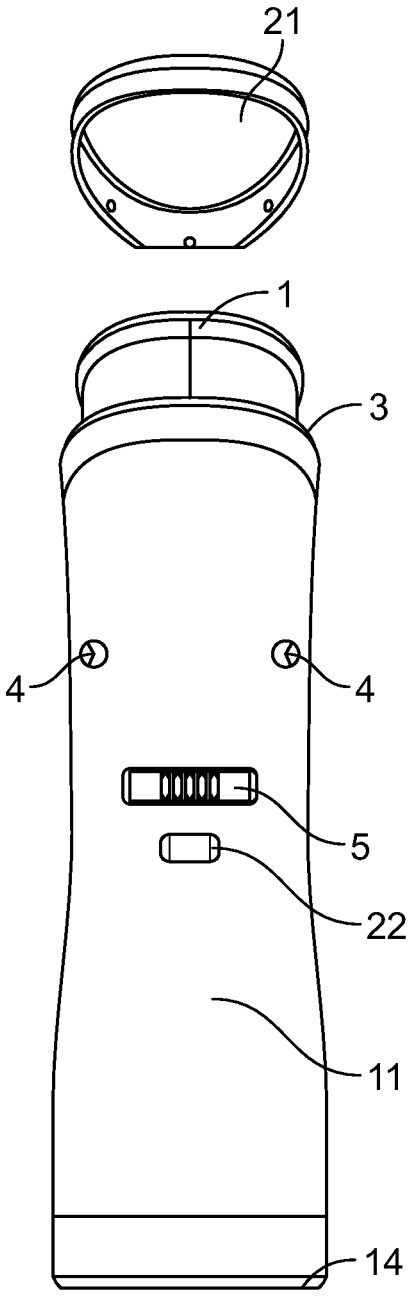
FIG. 2—Rear view of the embodiment showing applicator head 1, air outlet collar 3, ejector inlets 4, applicator control 5, enclosure 11, air intake 14, applicator head and lid/cover 21 and charging port 22.

1. Applicator head
2. Antiperspirant/Deodorant vessel or capsule
3. Air outlet collar
4. Ejector inlet
5. Applicator control
6. Power/Control button(s)
7. Mechanism for delivery of formula to applicator head
8. Air channel throat
9. Control module
10. Power source
11. Enclosure
12. Air channels
13. Air movement mechanism
14. Air intake
15. Enclosure lower section
16. Enclosure middle section
17. Enclosure Upper section
18. Core section
19. Coanda surface
20. Entrained air
21. Applicator head cover/lid
22. Recharging port
23. Structural Supports

PART NUMBERS FOR FIGS. 7-14

25 Applicator Head
26 Antiperspirant/Deodorant vessel or capsule
27 Air Intake
28 Enclosure
29 Control functions
30 Air outlet
31 Control module
32 Air Channels
33 Combined Power & Control module
34 Fan module
35 Inner structure
36 Mounting clips
37 Combined power & Fan module
38 Air intake channel
39. Mechanism for delivery of formula to applicator head

DEFINED TERMS

Carrier—The chemical formula that actually carries the antiperspirant or deodorant active ingredient. It is this carrier that needs to evaporate on the skin for it to feel dry.

DETAILED DESCRIPTION

Multiple embodiments are disclosed for a device for applying a substance to a surface and accelerating the drying of the substance. The device includes a vessel containing the substance to be applied or can be attached to a vessel. The vessel can be a vessel created by others or a vessel included in the design of the device. An applicator head is mounted or attached on a top of the vessel. The device includes an enclosure or housing and can be mounted with the vessel either by enclosing the vessel or attaching to the vessel. A mechanism to create and deliver a form of energy is located in the housing and directed toward the applicator head. Many forms of energy are usable including gas or air movement, heat, light, or any combination of those energy forms. The power source for the mechanism is chosen based on power required for the actual mechanism. Examples of power sources are an electric power source or an air or other gas source. If the power source is located within the device a battery can be used or a pressurized container of gas/air. A control module including control devices as warranted are included in or on the housing. In other embodiments the power source is external to the outer wall of the enclosure for the device. When the power source is located external to the device a power cord or hose is extended from i the enclosure to the power source. The power source can even be a user blowing into a hose connected to the enclosure.

Figure 3:
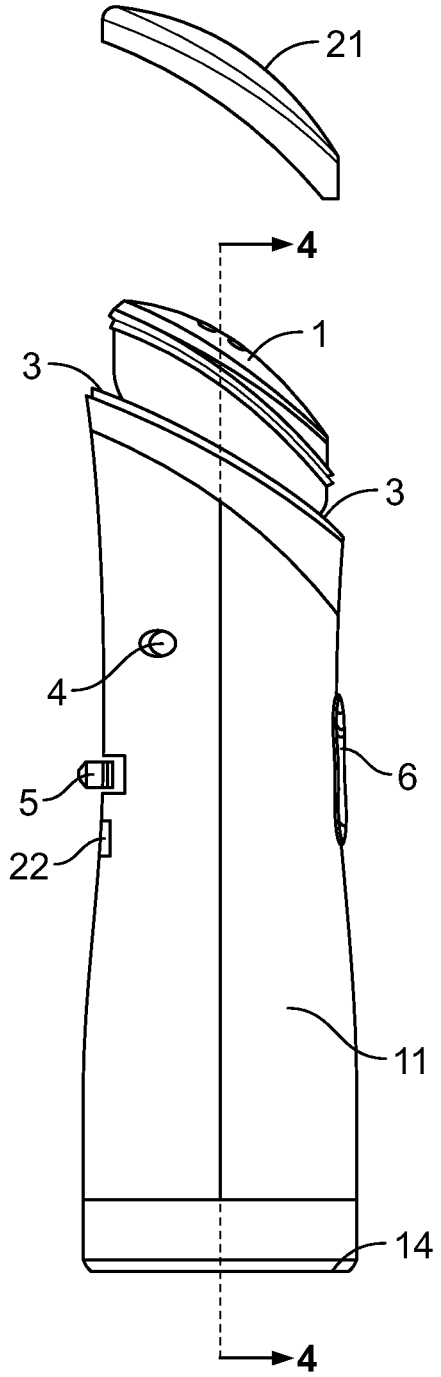
FIG. 3—Side view of the embodiment showing applicator head and lid 1, air outlet collar 3, ejector inlets 4, applicator control 5, power/control button(s) 6, enclosure 11, air intake 14 and applicator head lid/cover 21.
Figure 4:
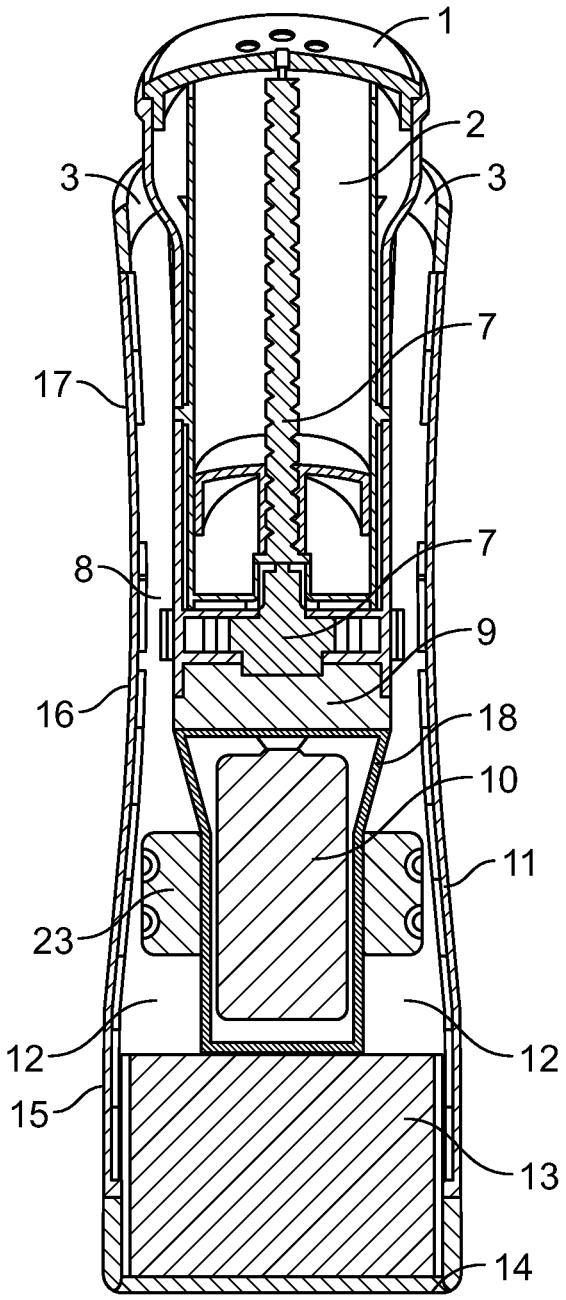
FIG. 4—Cross section of FIG. 3 showing applicator head 1, antiperspirant/deodorant vessel or capsule 2, air outlet collar 3, mechanism for delivery of formula to applicator head 7, air channel throat 8, Control module 9, power source 10, enclosure 11, air channels 12, air movement mechanism 13, air intake 14, enclosure lower section 15, enclosure middle section 16, enclosure upper section 17, core section 18 and structural supports 23.
Figure 5:
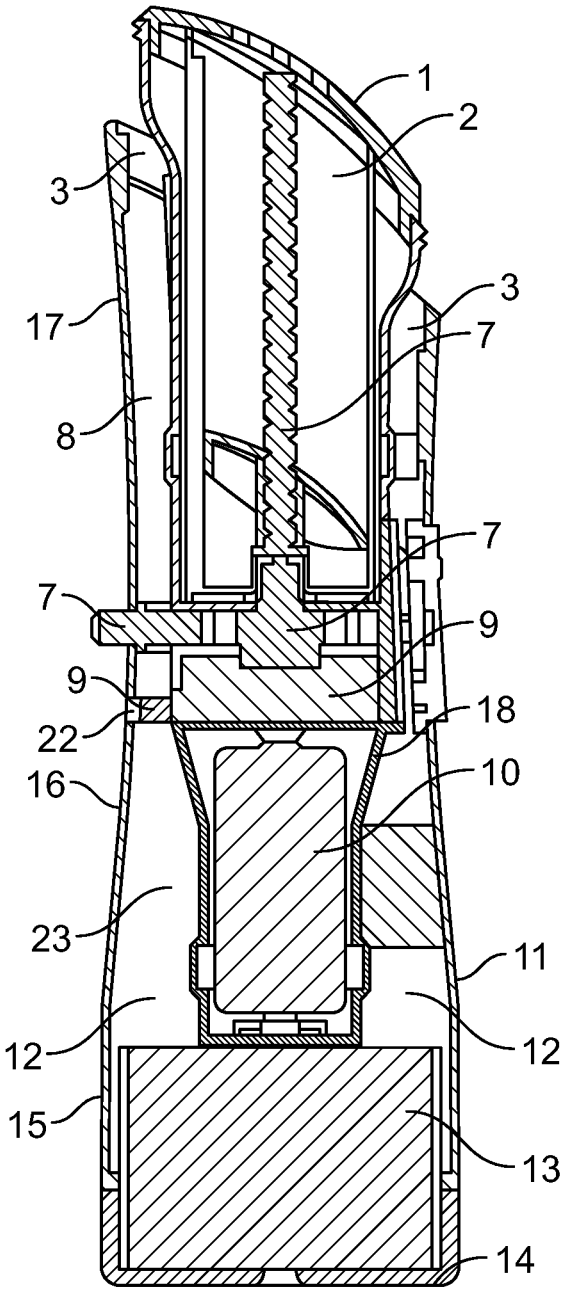
FIG. 5—Cross section of FIG. 1 showing applicator head 1, antiperspirant/deodorant vessel or capsule 2, air outlet collar 3, mechanism for delivery of formula to applicator head 7, air channel throat 8, Control module 9, power source 10, enclosure 11, air channels 12, air movement mechanism 13, air intake 14, enclosure lower section 15, enclosure middle section 16, enclosure upper section 17, core section 18, charging port 22 and structural supports 23.

One embodiment is shown on FIGS. 1-6. FIG. 4 shows the cross section front view and FIG. 2 the rear view. The applicator control 5 is moved by the user and a mechanism for delivery of the formula to the applicator head 7 translates movement into an upwards movement of a plunger or equivalent in order to cause pressure on the antiperspirant or deodorant gel in the antiperspirant/deodorant vessel or capsule 2. The resulting pressure moves the gel towards the applicator head 1 and onto the user by way of one or more opening such as small apertures in the surface of the applicator head 1. The applicator control 5 may be a button, wheel, sliding type switch or other means for the user interacting with the device. Possible mechanisms for delivery of the formula to the applicator head 7 include a screw type mechanism, a jacking or racking mechanism, a sliding push mechanism, a spring or other means known to those skilled in delivery mechanisms. The applicator head 1 is used to apply the antiperspirant or deodorant to the body with the shape of the applicator head 1 helping to spread the product evenly onto the surface of the skin. It is envisaged that the applicator head 1 will be attached to the antiperspirant/deodorant vessel or capsule 2 to form one unit although this could also be two distinct replaceable pieces.

It is envisaged that an alternative applicator surface could be employed such as a standard rollerball attached to a disposable or refillable vessel. The current design makes great use of the shape of the applicator head in order to create a coanda surface to help improve performance. Any alternative applicator surface would come with a different performance. An alternative applicator such as a rollerball could also eliminate the need for the mechanism for delivery of the formula to the applicator head.

FIG. 1 shows components of a control circuit for the fan including power/control button(s) 6. FIG. 4 shows a control module 9, a power source 10 and an air movement mechanism 13. Electrical connections between the devices in the control module utilize wiring or other types of electrically conducting connectors. The power/control button(s) 6 can be used to control the on/off and regulate the speed of airflow. The power/control button(s) 6 activates an electric air movement mechanism 13 such as a fan unit. In one embodiment the air movement mechanism 13 is a Vein Axial Flow fan using DC power. The device can be configured to utilize AC power. It is also envisaged that another embodiment may be designed to allow connection to an external power source as an alternative to the Power Source 10. Other embodiments utilize different air movement devices such as a bladeless device. In another embodiment the air movement/delivery mechanism 13 is compressed gas from a pressurized gas container, in which case an electrical control circuit may not be needed. In another embodiment a tube/hose can be provided to allow the user to blow air which is directed to the area of application of the substance to the user's surface.

The power/control button(s) 6 are a means for the user to activate and control the device. In other embodiments the power/control button(s) 6 utilize capacitive or resistive touch sensor as a means of interaction. The power/control button(s) 6 may also use acoustic touch sensor.

The control module 9 controls the device and can be designed to allow programming for control of the device. The control module 9 may control charging of the power source to increase power source life and make charging a safe process. It is also used to control the on/off and speed of the device. The control module 9 also can be programmed to control a visual alert utilizing one or more light emitting diode (LED) or some form of electronic display such as a liquid crystal display (LCD), organic light-emitting diode display (OLED), or an active-matrix organic light-emitting diode display (AMOLED). The visual alert can indicate information such as speed of the device air delivery, power source charging indicator, reserve of power source and the volume of deodorant/antiperspirant left in the antiperspirant/deodorant vessel or capsule 2. In one embodiment the display indicates how dry the deodorant/antiperspirant is on the skin. It is also envisaged that an audible alert could be used so the user could be aware for example that the power source energy is low and needs charging, that the deodorant is dry, that the device is being charged, or that the antiperspirant/deodorant vessel or capsule 2 is almost empty. To activate all of the alerts appropriate well known sensors are required in the control circuit such as voltage, humidity, pressure, etc. FIG. 3 shows a charging port 22, which is connected to the control module 9 by means of wires or other electrical conducting material.

In one embodiment the enclosure has a lower section 15 and bottom end, a middle section 16, and an upper section 17 with a top end. Referring to FIG. 4 the air movement mechanism 13 once activated draws air from the surroundings by way of the air intake 14 located at the bottom end of the lower section 15. This air is moved through an air channel 12 between an inner wall of the enclosure 11 and the core section 18 inside of the enclosure 11. The core section 18 houses the power source 10, control module 9, a vessel containing the substance to be applied 26, a mechanism 7 for delivery of formula to applicator head 1, and appropriate electrical connections. An inward taper of the enclosure 11 creates a reduction in annular cross sectional area in the air channel 12 as the air advances toward the outlet collar 3. This looks like a taper or pinch of the sidewalls. This results in an internal reduction in annular area for the air channel 12 at the point of the air channel throat 8. This reduction in annular area for the air to move through has the result of increasing air speed and decreasing the air pressure at the point of the air channel throat 8, caused by the conservation of energy principle.

After passing the air channel throat 8 the channel 12 features an outward taper or flare design allowing the fast moving air to expand. The faster moving air has lower pressure as it passes the ejector inlets 4. The Venturi effect of the fast moving lower pressure air pulls in air from air surrounding the enclosure 11 through the ejector inlets 4 and into the channel 12. This air becomes entrained air 20 and exits at the air outlet collar 3 along with air that is driven through the air channel 12 by the air movement mechanism 13. The result of the Venturi-Ejector principle is a multiplier effect of air moved. The volume of air that exits the air outlet collar 3 is greater than that which is moved by the air movement mechanism 13.

The air outlet collar 3 located in the upper section 17 and top end of the enclosure 11 is an aperture that surrounds the applicator head 1 such that air is delivered around the entire perimeter of the applicator head 1. The total surface area of the air outlet collar 3 is what determines the airspeed and pressure and will have an optimum efficient size for any given type of air movement mechanism 13 causing the movement of air in the main unit. The air outlet collar 3 in one embodiment surrounds the applicator head 1 like a collar but other embodiments utilize other designs such as a simple air flow hole or holes in varying shapes and sizes.

There are several variables to consider for maximizing the efficiency of the Venturi-Ejector. The first variable to consider is the amount of reduction in annular area at the air channel throat 8. The greater the reduction of the area of the air channel at this point the faster will be the air speed and resulting pressure drop, however this is limited by the capability of the air movement mechanism 13 being utilized. If a fan unit is utilized as the air movement mechanism 13, the torque capability of the fan unit must be considered. If the area is too small it will result in back pressure on the air movement mechanism 13 which must be considered. The number of ejector inlets 4 can be varied as desired since the principle that is important is the surface area of inlet as a percentage of the annular area at the air channel throat 8. This is designed to have an efficient ratio to maximize airflow. The angle of the enclosure 11 design where it flares outward after the air channel throat 8 is typically between 10-15 degrees to maximize efficiency of entrained air.

Other embodiments feature different designs to multiply the air. A more traditional Venturi design could be used where the air attracted to the low-pressure zone takes place at a different location of the enclosure for instance closer to the air movement mechanism 13. The embodiment shown in FIGS. 1-6 utilizes ejector inlets 4 that come after the pinch in the body to the direction of airflow. This is the Venturi-Ejector principle. Other fluid dynamics principles can be used to result in a similar effect to multiply air moved by entraining surrounding air.

Other embodiments may not use any principles to multiply or amplify the air; whilst this would be less efficient it would still improve drying compared to no air movement at all. Such an embodiment would just move air from an intake source through to an outlet with little or no manipulation or the source of air could just be a compressed gas canister that is moved through the device to an outlet. In such an embodiment employing a canister or vessel of compressed air as the air movement mechanism 13 it is also envisaged that a gas other than air could be used. Using a gas other than air could have other benefits that would enhance drying time further.

With regards to drying the antiperspirant or deodorant more quickly it is important to first understand how convection works. Convection decreases localized humidity caused by the evaporation of the carrier in the air around the skin application area until equilibrium of humidity is reached between the skin and the air around it. Moving air means that equilibrium is not reached which would slow the rate of evaporation, as saturated air will not hold any more carrier molecules. By keeping the air above the area of skin application clear of carrier molecules a differential gradient facilitates effective evaporation and also prevents gaseous carrier to condense back into the liquid form on the skin. Air that is moved across the surface of the skin will result in quicker drying times that air aimed directly perpendicular to the skin surface.

Figure 6:
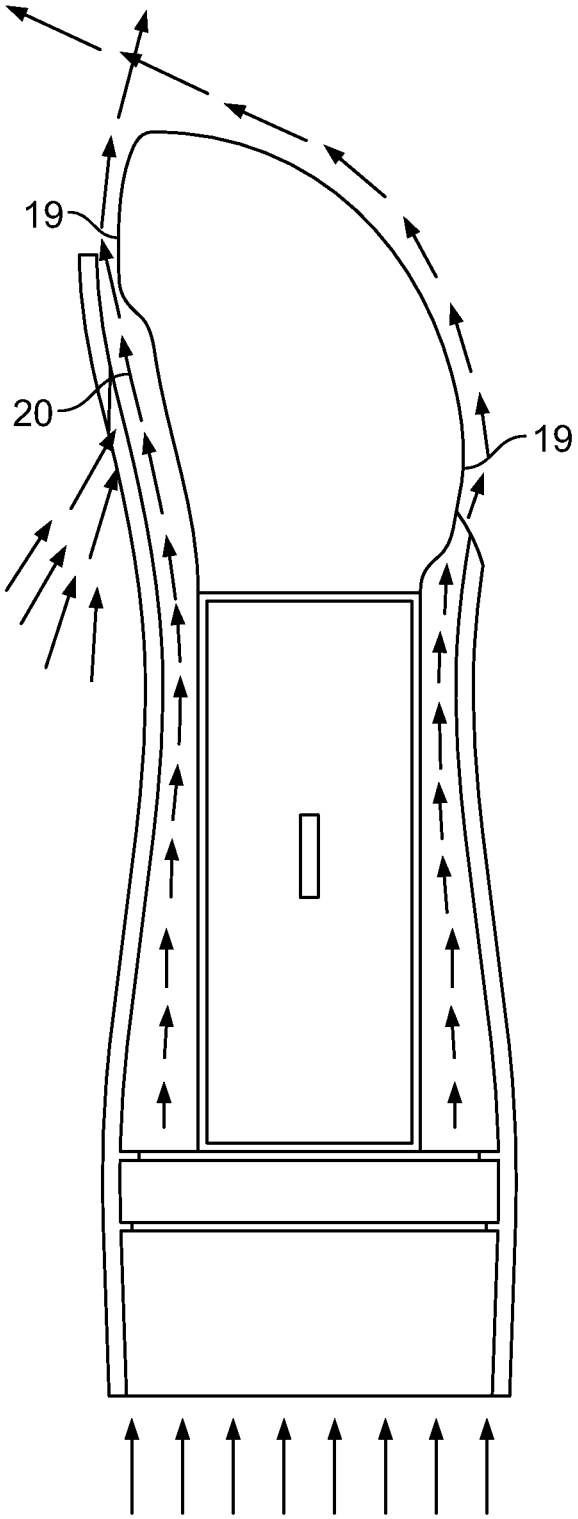
FIG. 6—Simplified cross section side view illustrating direction of airflow and the ejector system to multiply the air. In addition this figure depicts the aerodynamic Coanda effect created by Coanda surface 19 and entrained air 20.

The device disclosed facilitates the application of antiperspirant or deodorant and drying as quickly as possible. The design has therefore been made such that the multiplied air that exits at the air outlet collar 3 directs air movement across the skin to improve drying. The applicator head 1 is designed to create a coanda surface at the point of the air outlet collar 3. The arrows in FIG. 6 depict the airflow. Although FIG. 6 depicts a side cross section, the coanda airflow takes place around the total circumference of the applicator head 1. The resulting coanda airflow reduces the drying time of the carrier of the formula antiperspirant or deodorant as described above in the convection principle. It is perfectly possible that alternate embodiments would not use a coanda surface as whilst this improves drying it does add to the complication of design.

It is envisaged that other versions of the device could feature moving air that is heated by some method to improve the drying time further. It is important to note that in this current embodiment the air moved through the device will be heated by the presence of the control module 9, power source 10, and air movement mechanism 13 which generate heat when the device is activated. The heat generated by these components is minimal but, it is a secondary effect of operation. Deliberate heating can be added in several ways. A heat generating mechanism such as a traditional simple heating element can be included in the air movement mechanism 13 and controlled directly by a switch or by the control module 9.

The Venturi-Ejector and Coanda Surface have the combined effect of making the air moved by the air movement mechanism 13 feel softer on the skin but result in a increased volume of air moving in a direction to greatly reduce the drying time. It has also been envisaged that the single use or combined use of a Vortex of air could be used to achieve similar results.

Other embodiments include sensors to monitor parameters such as pressure, voltage, current, air flow, and humidity. These sensors can be used for indication or operational control by the control module 9.

Figure 7:
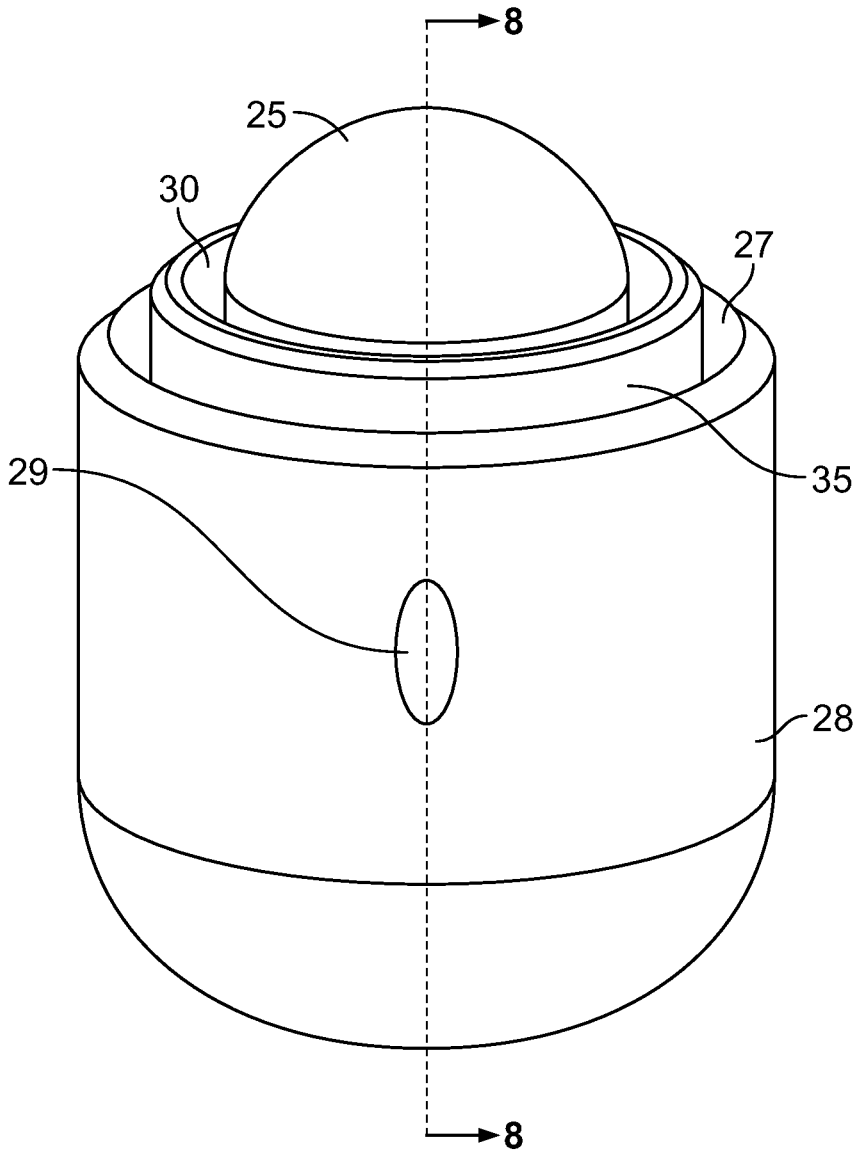
FIG. 7—Front view of another embodiment showing an applicator head 25, air intake 27, enclosure 28, control functions 29, air outlet 30, and inner structure 35.
Figure 8:
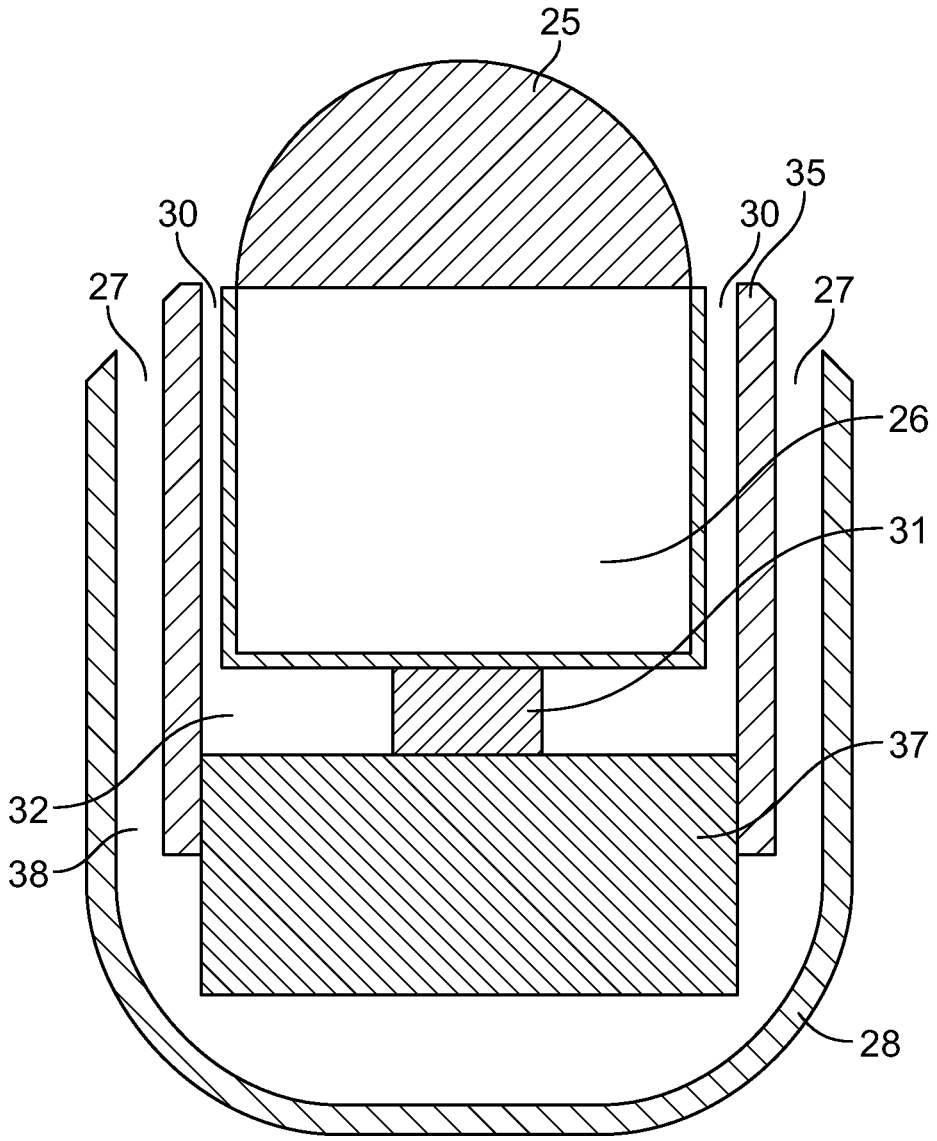
FIG. 8 is a cross section of FIG. 7 showing additional components of this embodiment antiperspirant/deodorant vessel 26, control module 31, air channel 32, combined power and fan module 37, and air intake channel 38.

It is envisaged that another embodiment of the invention would also use a means of moving air but it envisaged that the movement of air could be reversed such that the air intake area is close to the surface of the skin. This would achieve improved drying of but in effect using suction of saturated air away from the surface of the skin. This could be achieved with or without fluid dynamic principals such as the Ejector or Venturi that multiply the air moved through the device. FIGS. 7 & 8 depict an alternative embodiment to demonstrate this possibility. Air is drawn away from the surface via air intake 27 and then pushed back to the surface via the air outlet 30. In this case the air is both withdrawn and moved back to the same surface. Air could also be just withdrawn via the air intake 27 and the air outlet 30 could be aimed away from the surface to be dried. Such alternative embodiments allow for different configurations of the components of the device in order to facilitate different shapes for the design of the device.

Figure 11:
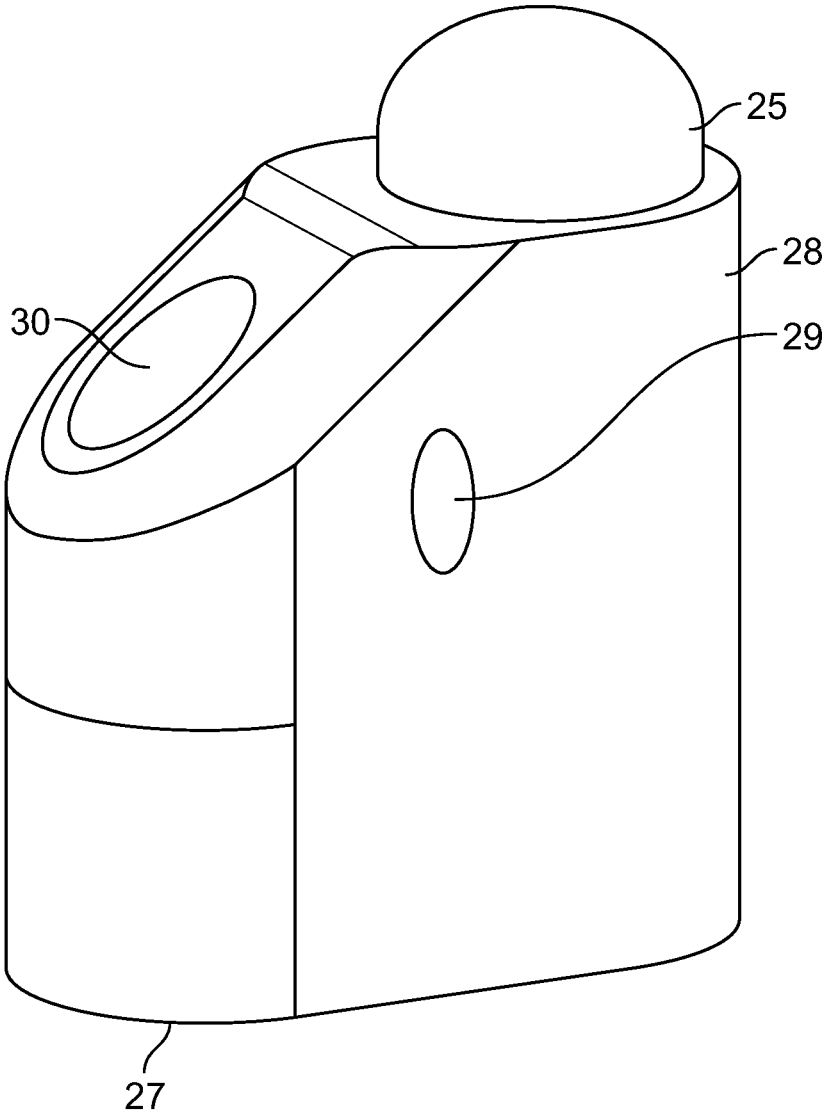
FIG. 11 depicts another embodiment showing applicator head 25, air intake 27, enclosure 28, control functions 29, and air outlet 30.
Figure 12:
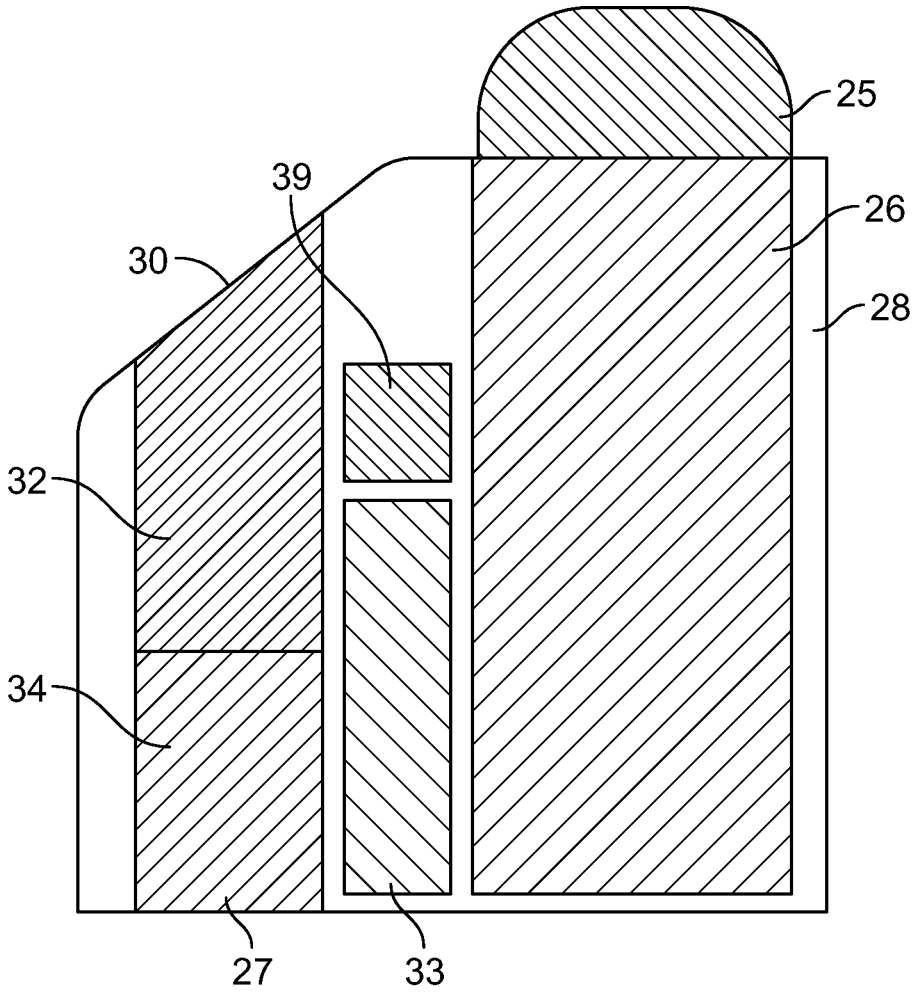
FIG. 12 is a cross section of FIG. 11 showing additional components antiperspirant/deodorant vessel 26, air channel 32, power and control module 33, and fan module 34, and mechanism for delivery of formula to applicator head 39.

The embodiment shown in FIGS. 1 through 5 uses a vertical stack of components: the applicator head 1, antiperspirant/deodorant vessel or capsule 2, mechanism for delivery of formula to applicator head 7, air channel throat 8, control module 9, power source 10, air channels 12, air movement mechanism 13, air intake 14. It is envisaged that these components could be organized in a different configuration. For example the power source 10 and control module 9, could be positioned around the air movement mechanism 13. The air intake 14 could actually be located on the enclosure 11 in a different location. Whilst these different combinations would not necessarily change the performance of the invention but they would allow for different designs in terms of shapes and sizes. The antiperspirant/deodorant capsule 2 could be positioned outside of the air channels 12 such that it sits parallel to the air channel or even perpendicular or at some angle in between. FIGS. 11 and 12 show such a possible embodiment. These are intended an example of the possible configurations for another embodiment of the device. It has also been envisaged that for the current embodiment and the further versions discussed any of these could be used with a less sophisticated design that would just use an air movement device without the use of fluid dynamic principals to multiply or amplify the air moved. This would be less efficient that the current embodiment but would still lead to improved drying.

Figure 9:
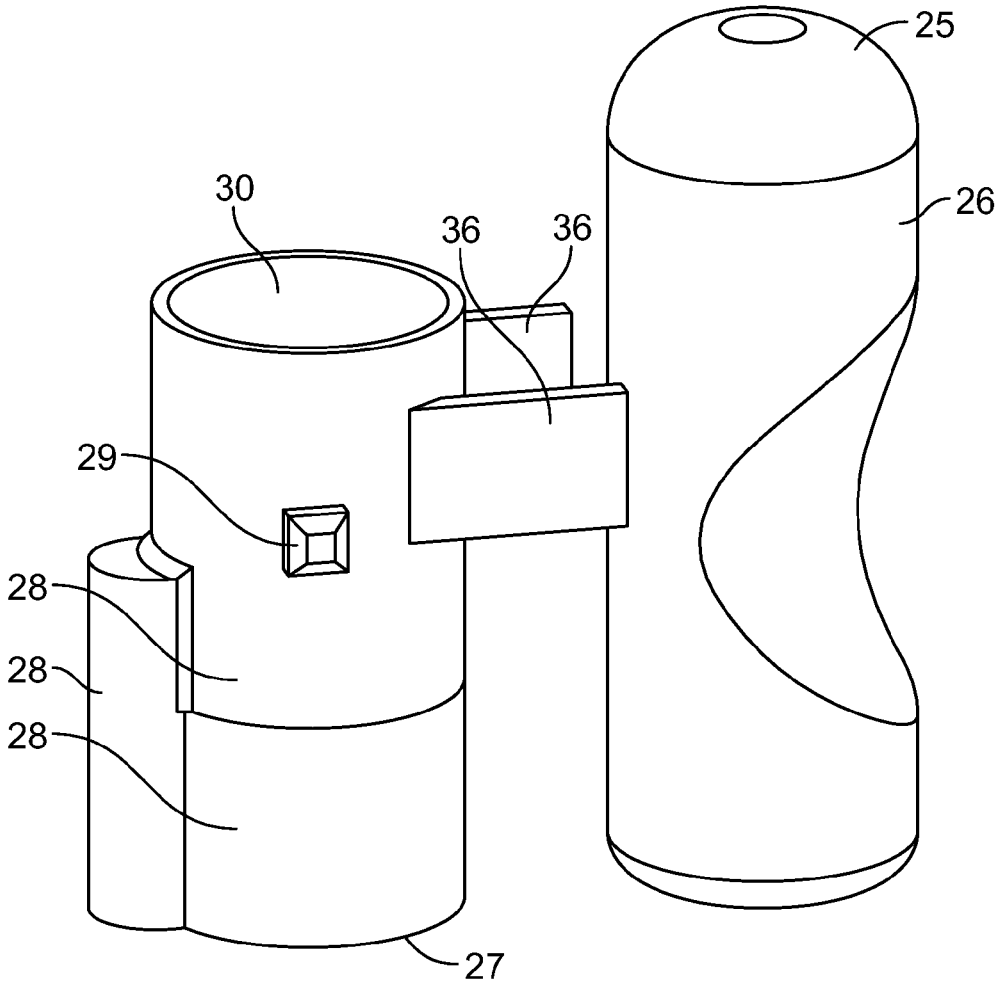
FIG. 9 is a front view of another embodiment showing applicator head 25, antiperspirant/deodorant vessel 26, enclosure 28, control functions 29, air outlet 30, and mounting clips 36.
Figure 10:
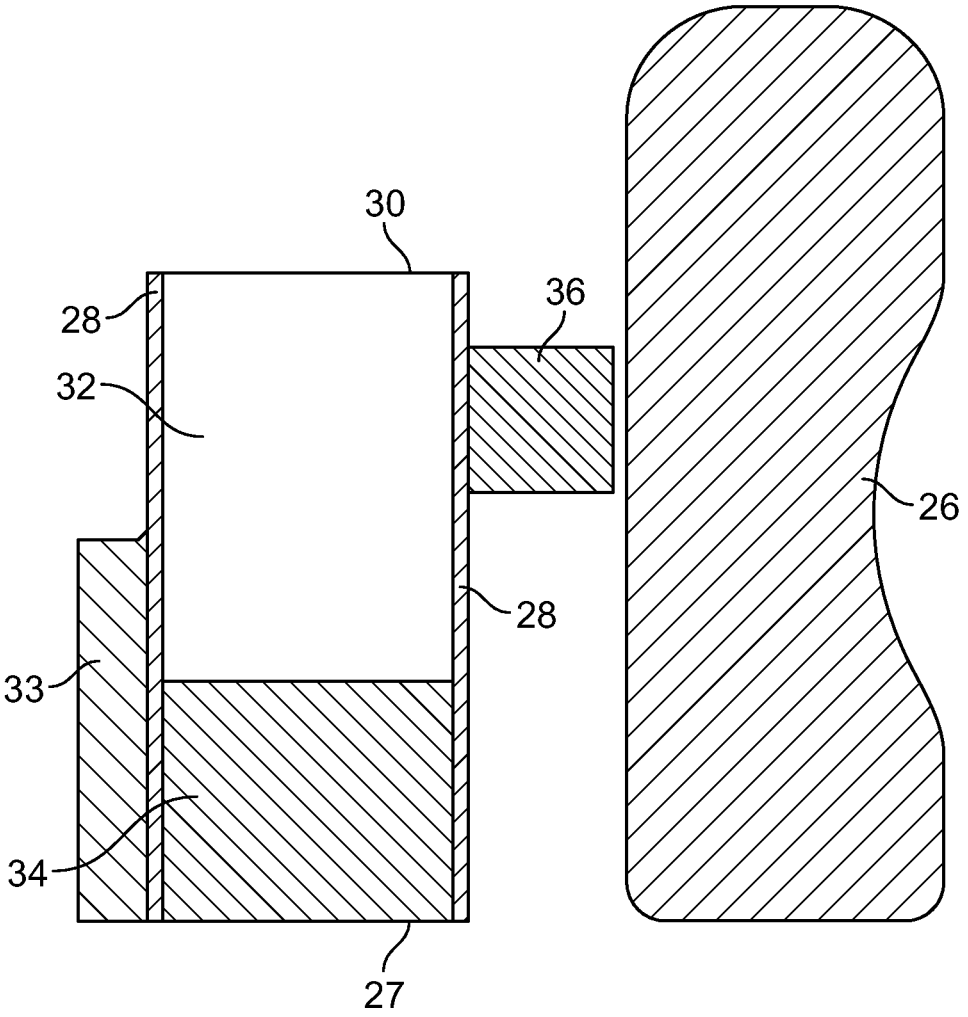
FIG. 10 is a cross section of FIG. 9 showing additional components combined power and control module 33, and fan module 34.

A less sophisticated design that could achieve a similar effect of improved drying would be a further embodiment where the air movement device and control of such could be combined with existing third party deodorants/antiperspirants. Such an embodiment could take the form of a clip on device to existing popular deodorants/antiperspirants. FIGS. 9 and 10 show this possibility.

One embodiment uses a proprietary formula of deodorants/antiperspirant and includes an embodiment in which it has been envisaged that the formula could be altered to enable enhanced drying with light curing technology. This would require an additional source of light at a particular frequency to dry the formula. This light source would be built into the device and could be combined with the moving air for further improvement in drying. The use of an existing third party formula would work very well with the current embodiment as long as the vessel holding the antiperspirant/deodorant was the same shape and design.

Figure 13:
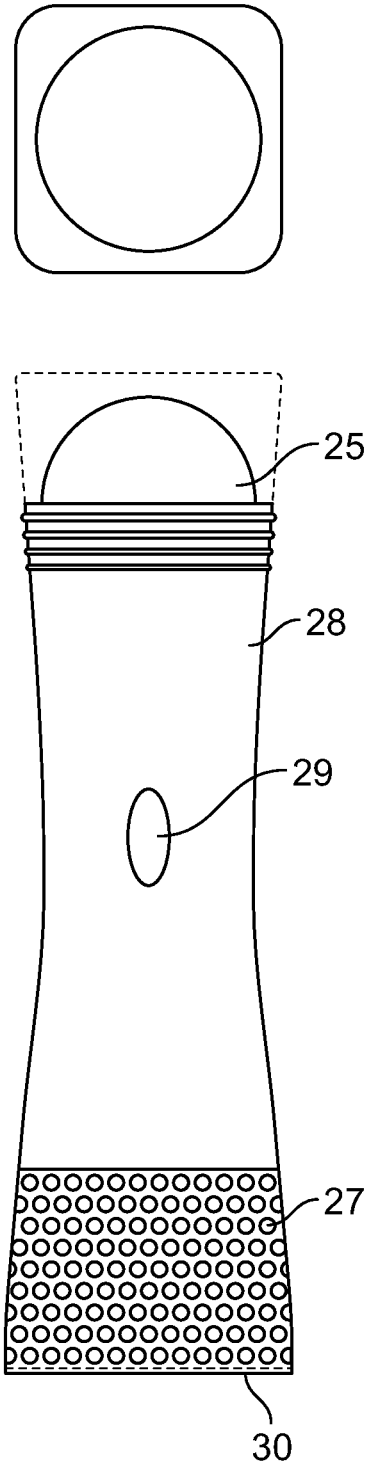
FIG. 13 depicts another embodiment.
Figure 14:
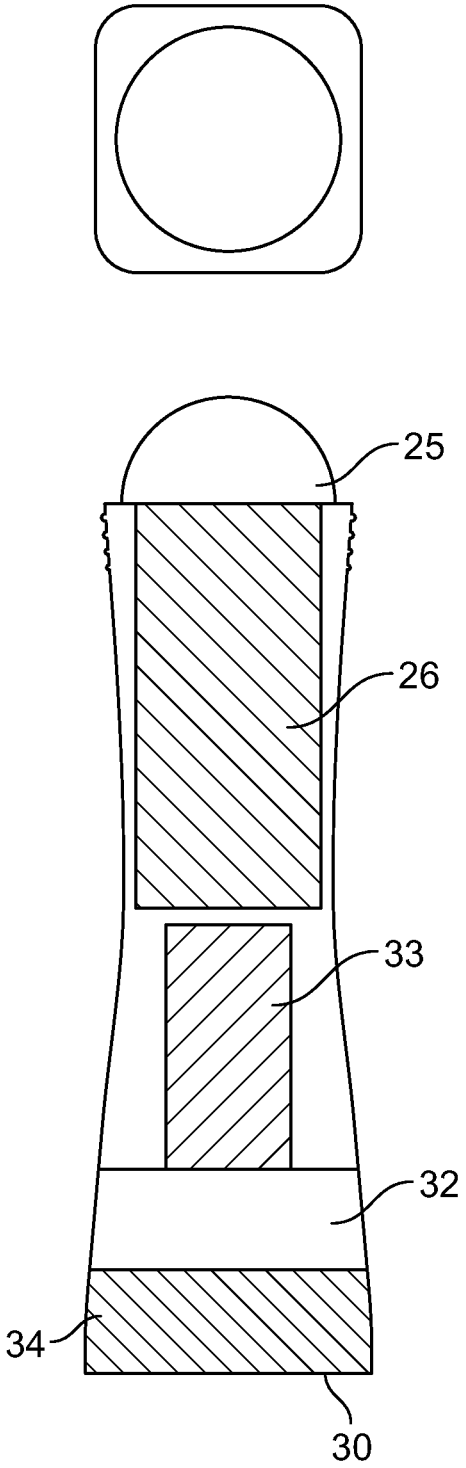
FIG. 14 depicts a cross section of the embodiment in FIG. 13.

In another embodiment shown on FIGS. 13 and 14 an air movement/delivery mechanism 34 is located in an enclosure 28 with the vessel 26 containing the deodorant/antiperspirant. A removable cap for the enclosure is also shown on the Figures. The applicator head 25 is on top of the vessel 26 at a top end of the enclosure. The air delivery mechanism 34 draws air from one or more openings in the side of the vessel and delivers the air through an air outlet 30 on the bottom of the vessel. This requires turning the vessel over after applying the deodorant/antiperspirant to accelerate the drying of the deodorant/antiperspirant. The device can also be configured such that the air is directed toward the top of the applicator head 25 in the enclosure.

In other embodiments this application device can be designed for the application of other products such as lotions, creams and gels utilized for other purposes beyond antiperspirants and deodorants. In all these other applications, the feature of removable, exchangeable, replaceable, or refillable vessels as well as attachment to existing device for applying a substance to a surface can be utilized.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

We claim:

1. A device for applying a substance to a surface comprising:

an enclosure with an outer wall, an upper section, a middle section, and a lower section;

an air intake located in the lower section of the enclosure;

an air outlet located in the upper section of the enclosure;

a core section in the enclosure includes an air movement mechanism, a vessel containing the substance to be applied, a substance movement mechanism for forcing the substance to be applied to a top end of the vessel, and a control module to control the air movement mechanism and the substance movement mechanism;

at least one air channel created between the enclosure and the core section; and an opening in the top end of the vessel.

2. A device according to claim 1 further comprising an applicator head, which is designed to create a coanda effect, is located on the top of the vessel in the core section.

3. A device according to claim 1 further comprising an air channel throat created in the air channel by an inward taper in the enclosure toward the core section; and at least one ejector inlet located on the enclosure wherein the ejector inlet is located between the air outlet in the enclosure and the air channel throat.

4. A device according to claim 3 further comprising an applicator head which is designed to create a coanda effect is located on the top of the vessel in the core section.

5. A device for applying a substance to a surface according to claim 4 wherein the air movement mechanism is a fan which is powered by a power source located in the core section.

6. A device for applying a substance to a surface according to claim 4 wherein the air movement mechanism is a fan which is powered by a power source located external to the device.

7. A device for applying a substance to a surface according to claim 4 wherein the substance to be applied is a deodorant and the surface is a person's skin.

8. A device for applying a substance to a surface according to claim 4 wherein the substance to be applied is a lotion and the surface is a person's skin.

9. A device for applying a substance to a surface according to claim 4 wherein the vessel is designed to be removable.

10. A device for applying a substance to a surface according to claim 4 wherein the vessel is designed to be refillable.

11. A device for applying a substance to a surface according to claim 4 wherein the taper in the enclosure is a taper inward in the middle section which then expands outward in the upper section.

12. A device for applying a substance to a surface according to claim 11 wherein the substance to be applied is an antiperspirant and the surface is a person's skin.

13. A device for applying a substance to a surface according to claim 4 further comprising a heat generating mechanism to create and deliver heat, and power source and controls for the heat generating mechanism.

14. A device for applying a substance to a surface according to claim 4 wherein the air movement mechanism is a pressurized gas container.

15. A device for applying a substance to a surface according to claim 14 wherein the substance to be applied is a deodorant and the surface is a person's skin.

16. A device for applying a substance to a surface according to claim 4 wherein the taper in the enclosure is a taper inward in the lower section which then expands outward in the upper section.

17. A device for applying a substance to a surface according to claim 4 wherein the mechanism for forcing the substance to be applied to the top end of the vessel is a screw type mechanism.

18. A device for applying a substance to a surface according to claim 4 wherein the substance to be applied is an antiperspirant and the surface is a person's skin.

19. A device for applying a substance to a surface according to claim 4 wherein the mechanism for forcing the substance to be applied to the top of the vessel, is a jacking mechanism.

20. A system for applying a substance to a surface comprising:

select the device in claim 1 use the control device for the mechanism for forcing substance to the top end of the vessel to push the substance onto the applicator head;

press the applicator head against the surface;

and use the control device for the air movement mechanism to create air movement.

21. A system for applying a substance to a surface according to claim 20 wherein the air movement mechanism is a fan which is powered by a power source located in the core section.

22. A system for applying a substance to a surface according to claim 21 wherein the substance to be applied is a deodorant and the surface is a person's skin.

23. A system for applying a substance to a surface according to claim 20 wherein the substance to be applied is an antiperspirant and the surface is a person's skin.

* * * * *